US006635978B1

(12) United States Patent
Clerc

(10) Patent No.: US 6,635,978 B1
(45) Date of Patent: Oct. 21, 2003

(54) ELECTRON TUBE WITH AXIAL BEAM AND PYROLITIC GRAPHITE GRID

(75) Inventor: Guy Clerc, Thonon-les-Bains (FR)

(73) Assignee: Thomson Tubes Electroniques, Meudon la Foret (FR)

( * ) Notice: Subject to any disclaimer, the term of this patent is extended or adjusted under 35 U.S.C. 154(b) by 0 days.

(21) Appl. No.: 09/622,165

(22) PCT Filed: Feb. 12, 1999

(86) PCT No.: PCT/FR99/00171

§ 371 (c)(1),
(2), (4) Date: Aug. 14, 2000

(87) PCT Pub. No.: WO99/41762

PCT Pub. Date: Aug. 19, 1999

(30) Foreign Application Priority Data

Feb. 13, 1998 (FR) ..... 98 01760
Feb. 24, 1998 (FR) ..... 98 02202

(51) Int. Cl.[7] ..... H01J 1/46
(52) U.S. Cl. ..... 313/293; 313/348; 313/308
(58) Field of Search ..... 313/293, 295, 313/299, 308, 348, 349, 356

(56) References Cited

U.S. PATENT DOCUMENTS 3,453,482 A * 7/1969 Priest ..... 315/5.29
3,818,260 A * 6/1974 Elfe et al. ..... 313/299
3,843,902 A * 10/1974 Miram et al. ..... 313/299
4,227,116 A * 10/1980 Miram et al. ..... 313/295
4,229,674 A * 10/1980 Hoet ..... 313/348
4,429,250 A 1/1984 Clerc et al.
4,563,609 A 1/1986 Clerc et al.
4,577,134 A 3/1986 Clerc
4,745,326 A * 5/1988 Greene et al. ..... 313/293
5,399,935 A * 3/1995 Santonja et al. ..... 313/447
5,650,751 A * 7/1997 Symons ..... 313/293
5,682,084 A 10/1997 Langlois et al.
5,936,335 A 8/1999 Clerc
5,990,621 A * 11/1999 Sobieradzki ..... 315/5
5,990,622 A * 11/1999 Schult et al. ..... 315/5.37

* cited by examiner

*Primary Examiner*—Ashok Patel
*Assistant Examiner*—Glenn D Zimmerman
(74) *Attorney, Agent, or Firm*—Oblon, Spivak, McClelland, Maier & Neustadt, P.C.

(57) ABSTRACT

A grid for an electron tube with an axial beam which includes an apertured part through which the electrons of the beam are intended to pass. The grid is in the form of a bell and is made of a single material. The apertured part is located at the top of the bell but is placed in the bottom of a hollow so that the electrons passing through the grid around its periphery are focused onto the axis. Such a grid may find particular application to IOT-type tubes.

12 Claims, 4 Drawing Sheets

ELECTRON TUBE WITH AXIAL BEAM AND PYROLITIC GRAPHITE GRID

BACKGROUND OF THE INVENTION

1. Field of the Invention

The present invention relates to the field of grid-type axial-beam electron tubes and especially to those with inductive output, known by the abbreviation IOT (standing for Inductive Output Tube). It relates more particularly to the grid of these tubes.

2. Discussion of the Background

An IOT comprises an electron gun which emits an electron beam directed along a longitudinal axis, this beam passing through a resonant cavity with which it interacts, before being received in a collector which adjoins the resonant cavity.

In these tubes, the gun has a cathode generally with a concave emissive part, a heater, a control grid and an anode, the grid being located between the cathode and the anode.

The grid serves to modulate the emission of electrons so that they are grouped in packets as soon as they are emitted by the cathode. The beam thus modulated passes through the single cavity from which electromagnetic energy is extracted. These tubes have an efficiency and a high gain.

FIG. 1 illustrates highly schematically a known electron gun for an IOT-type tube. The thermoemissive cathode bears the reference 1. It is solid, with a concave emissive face 2. A heater 3, which heats by conduction or radiation, is located opposite the emissive surface of the cathode 1. The control grid bears the reference 4. It is placed so as to face the emissive surface 2 of the cathode 1. It is very close to the latter—the gap which separates them may be of the order of a few tenths of a millimetre.

Next, there is an anode 5 provided with a central opening 6.

The electrons form a beam (not shown) directed along the XX' axis. In this beam, the electrons are grouped in packets as soon as they pass through the central aperture 6. Beyond the central opening 6, they penetrate into the body of the tube (shown in dotted lines), from the resonant cavity as far as the collector.

The grid 4 has an apertured part 7 with bars in a central region and a peripheral solid part 8, the assembly being in the form of a disc which is substantially plane or slightly concave in order to follow the emissive surface 2 of the cathode 1. The grid 4 is delicate and its bars are thin. The grid 4 is intended to be connected to a grid connection piece 10 located at the base of the gun, on the opposite side from the grid 4 with respect to the heater 3. It receives via this piece 10 an electrical modulation signal. This connection is made by means of an electrically conducting support 9 fastened on one side to the solid part 8 of the grid 4 and on the other side to the grid connection piece 10. This support 9 is formed by joining together several approximately cylindrical pieces, one of which, 91, surrounds the grid 4.

Also around the base of the gun, in addition to the grid connection piece 10, there is a cathode connection piece, a heater connection piece and an anode connection piece. These connection pieces are not shown. They are separated from one another by dielectric spacers. These connection pieces 10 are remote from the cathode 1 and from the heater 3, and are therefore not exposed to high temperatures.

The support 9 for the grid 4 is located close to the cathode and it surrounds it. It is generally made of metal because of its electrical properties, since it contributes to transmitting the modulation signal to the grid 4.

In the prior art, and for thermoelectric property reasons, the grid 4 is made of pyrolytic graphite, a material known for its very small expansion coefficient in the deposition plane.

The grid 4 is subjected to high thermal and electrical stresses, but in order to fulfil its role and to modulate the beam effectively, it must be capable of withstanding them without deforming.

The grid-cathode gap must remain approximately constant during operation of the tube this is an important parameter in the effectiveness of the modulation and the stability of the signal.

The grid 4 heats up, on the one hand because of its closeness to the thermoemissive cathode 1 and on the other hand because of the emitted electrons which inevitably strike it.

When the tube is in use, a differential expansion between the grid 4 and its support 9 occurs since they do not have the same expansion coefficient. The grid is generally made of pyrolytic graphite and the support 9 made of metal.

This differential expansion results in stresses on the grid 4 which may deform the apertured region 7 if the grid is tightly fastened to the support 9 and may cause the grid 4 to come into contact with the cathode 1 or, at the very least, may alter the modulation of the electron beam.

It has been proposed, as in FIG. 1, to mount the grid 4 on its support 9 in an elastic manner with the aid of an elastic joint 11 which is electrically conductive. This joint absorbs the differences in expansion. A relative sliding movement between the grid 4 and the support 9 is possible during the expansion, thereby preventing excessively high mechanical stresses in the grid 4. However, it is difficult to ensure that the cathode and the grid are coaxial. There is a risk of the gap between the grid and the cathode varying. Another drawback with this structure is that it is expensive to produce. The elastic joint 11 must leave a mechanical clearance between the grid 4 and the support 9 without correspondingly interrupting the electrical continuity between the two. Fitting the joint is tricky and requires a complicated support 9 with several pieces joined together.

SUMMARY OF THE INVENTION

The present invention seeks to alleviate these drawbacks and to this end provides a grid for an axial-beam electron tube with improved performance which is particular simple to produce. It results in an inexpensive gun which makes it possible, in operation, to maintain an accurately defined cathode-grid distance independent of the temperature stabilization time of the various electrodes. It makes it possible to dispense with the metal grid support.

More particularly, in order to achieve this, the grid according to the invention has the shape of a bell and is made of a single material, this bell having at its top an apertured part, this part being approximately transverse to the axis of the beam.

The grid will preferably be made of pyrolytic graphite because of its thermal, electrical and mechanical properties which are suitable for this type of application. Preferably, the grid is made as one piece.

To improve the focusing of the electrons which pass through the grid around the periphery of the apertured part, it is possible for the top of the bell to be configured in the form of a hollow, to place the apertured part in the bottom of the hollow and to border the apertured part with a tubular wall attached to the skirt by an annular part which separates it from the skirt.

The grid is intended to be fastened at the base of the bell to a grid connection piece.

This grid connection piece may comprise a sleeve around which the grid is fitted.

The fastening between the grid and the grid connection piece may be achieved, for example, by soldering or screwing. In order to further improve the performance of the grid, it is advantageous to provide a series of slots oriented approximately along the axis of the electron beam at the base of the grid. This series of slot allowing elastic compensation of the differences in expansion that can occur between the grid and the grid connection piece.

The present invention also relates to an axial-beam electron tube equipped with such a grid.

BRIEF DESCRIPTION OF THE DRAWINGS

Further features and advantages of the invention will appear on reading the following description of examples of grids, this being illustrated by the figures which show, schematically.

In these figures, the scales have not been respected for the sake of clarity.

Figure 1:
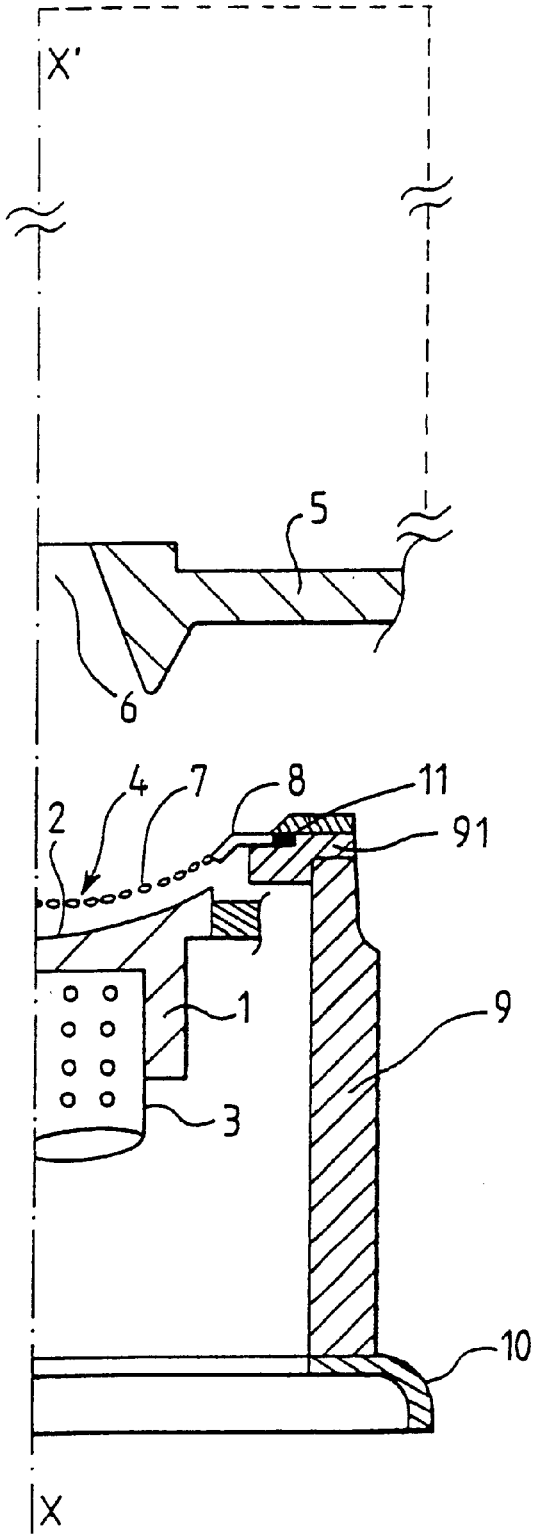
FIG. 1 (already described), an axial-beam electron tube whose gun has a known grid.
Figure 2:
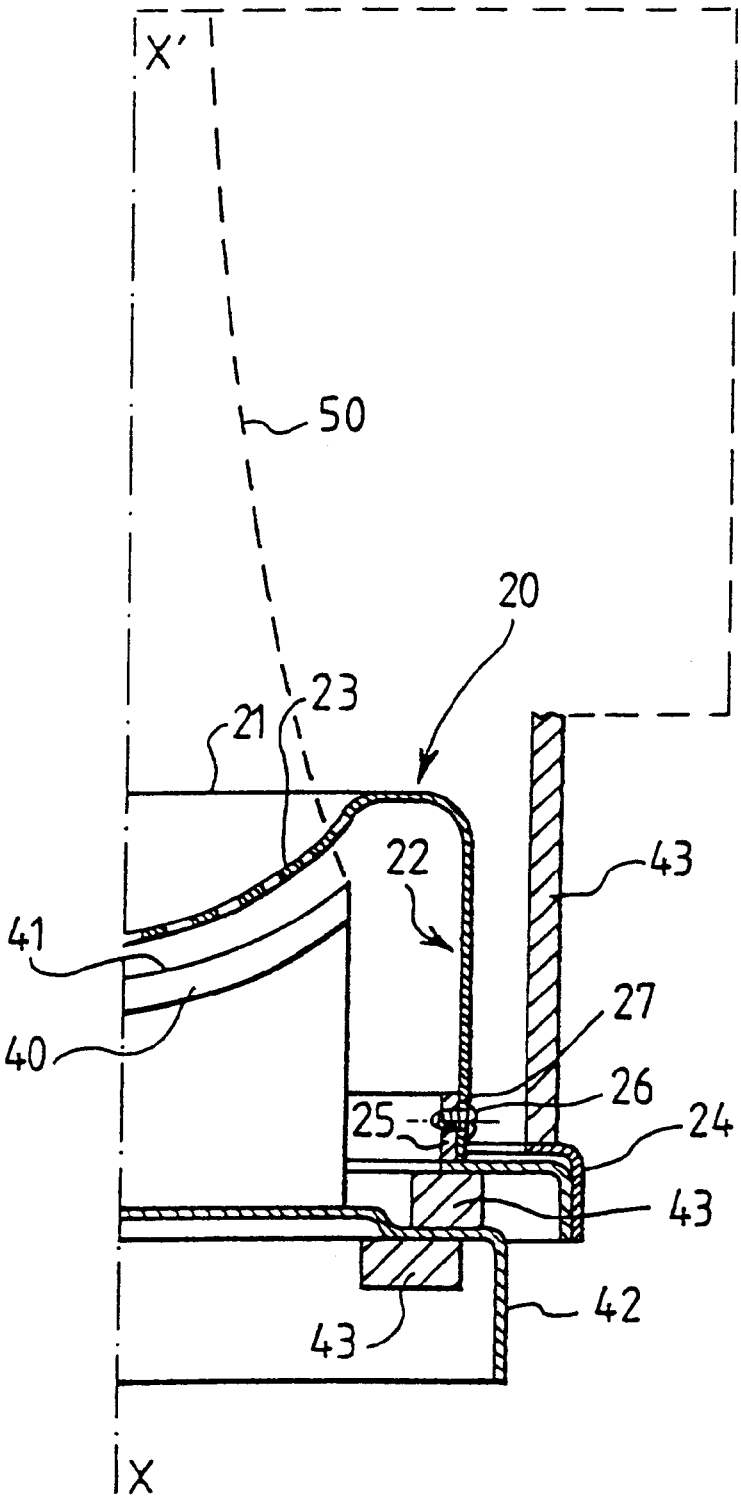
FIG. 2 an axial-beam electron tube according to the invention, whose gun has a grid according to the invention.

FIG. 2 shows schematically a grid 20 according to the invention, mounted in an electron tube with an axial beam 50 directed along the XX' axis. It is assumed that the tube is an inductive output tube (IOT). Only part of the tube's gun is shown, the rest is indicated schematically by dots. The grid 20 has the shape of a bell 22 and is made of a single material.

This bell 22 has a top 21 and is extended by an approximately cylindrical skirt down to a base 27.

The apertured part 23 of the grid 20, approximately transverse to the XX' axis of the beam, is located at the top 21 of the bell. This apertured part 23 is intended to be placed so as to face the active surface 41 of the cathode 40 when it is mounted in the gun of the electron tube. The apertured part 23 follows the surface of the active part 41 of the cathode 40 and, for this purpose, it may be concave, in the form of a dish, which is approximately spherical for example.

Figure 3A:
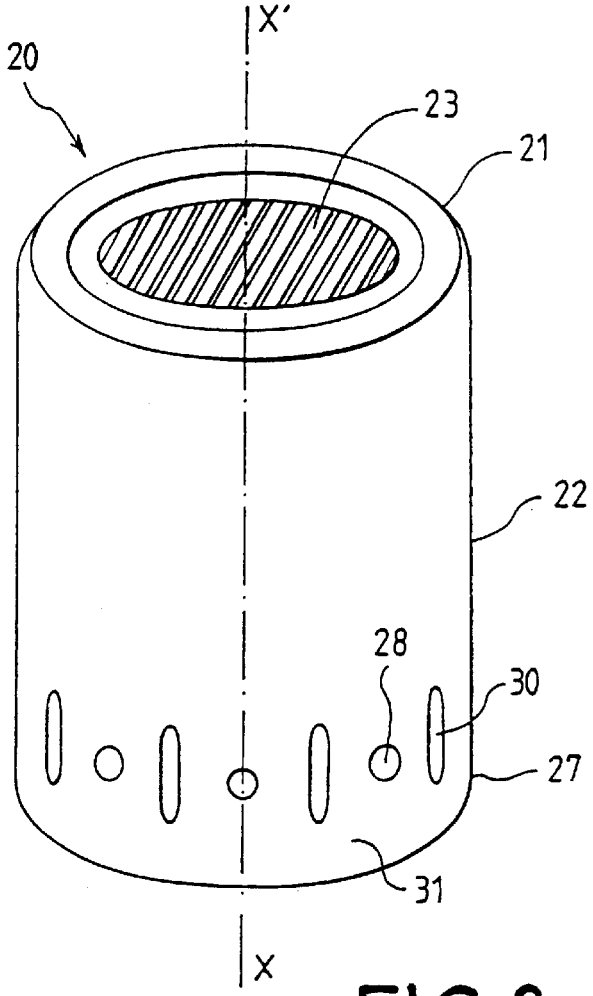
FIG. 3*a*, a perspective view of a grid according to the invention with a series of slots and FIGS. 3*b*, 3*c* various alternative forms for the slots.

Other configurations are possible, such as a plane apertured part 23 as shown in FIG. 3*a*.

The grid 20 is made of a single material, from the top 21 of the bell down to its base 27. This characteristic contributes to solving the deformation problem caused by the differential expansions encountered in the prior art. With such a bell-shape structure made of a single material, it is no longer necessary to provide a metal support near the cathode 40 between the apertured part 23 and the grid connection piece 24.

The base 27 of the bell 22 is fastened to the grid connection piece 24, this piece 24 serving for supplying the electrical modulation signal applied to the grid 20.

The grid connection piece 24 is remote from the cathode 40 and is located near the cathode connection piece 42. In the region of the connection pieces, the temperature never becomes as high as in the region of the apertured part 23 facing the active surface 41 of the cathode. The damaging effects of the differential expansion between the grid 20 and the grid connection piece 24 are not significant on the apertured part 23.

The electrically conducting grid connection piece 24 may include a sleeve 25 around which the base 27 of the bell 22 is fitted. The grid 20 may be fastened to the sleeve 25 using screws 26 which pass through the sleeve 25 and the skirt of the bell 22. For this purpose, holes 28 in the skirt of the bell 22 and internal threads in the sleeve 25 are provided in order to receive the screws 26.

FIG. 3*a* shows a perspective view of a grid 20 according to the invention with holes 28 in the skirt of the bell 22. The apertured part 23 is drawn hatched for the sake of clarity. This structure is not limiting.

Another type of fastening may consist of a soldered joint between the base 27 of the bell 22 and the grid connection piece 24.

In order to further reduce the damaging effects of the differential expansion between the grid 20 and the grid connection piece 24, it is possible to provide a series of longitudinal slots 30 around the perimeter of the base 27 of the bell, these slots providing a certain amount of flexibility in the region of the inevitable deformations which occur during heating. These slots 30 provide elastic compensation for the differential expansion and eliminate the mechanical stresses in the grid.

It is possible for these slots 30 not to run out to the lower edge of the skirt of the bell 22 but stop short, so as to define a spacer 31 between the base of the bell 22 and the end of the slots 30.

After mounting, the base of the bell divides into a certain number of stripes separated by the width of the slots. These slots 30 do not degrade the electrical contact with the grid connection piece 24. The spacer 31 ensures rigidity of the base 27 of the bell before mounting on the sleeve 25, but after tightening it may break. The holes 28 are located between the slots 30 in the example shown.

The slots 30 may have a constant width, but it is also conceivable for them to have an upper part 30.1 and a lower part 30.2 which differ in width, these two parts being connected to each other.

Figure 3B:
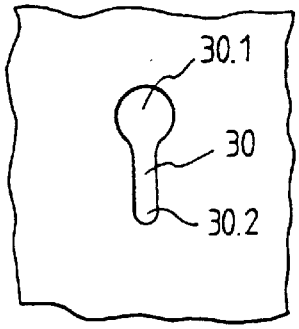
Figure 3C:
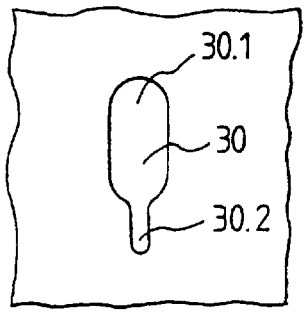

FIGS. 3*a*, 3*b*, 3*c* show several configurations of slots 30. In FIG. 3a, the slots 30 have a constant width. In FIG. 3*b*, the upper part 30.1 is wider than the lower part 30.2, and in FIG. 3*c* the opposite is the case.

These slots 30 and these holes 28 may be produced by any known means, such as by sawing or sand-jet machining, for example.

Advantageously, the grid 20 is made oft pyrolitic graphite which has thermal, mechanical and electrical properties which are particularly well suited to this application. The techniques for producing one-piece pyrolitic graphite grids are well mastered. However, other materials can be used.

The grid connection piece 24 may be made from an electrically and thermally conducting material, typically copper, molybdenum, an iron-nickel-cobalt alloy or the like.

The sleeve 25 may also be made of the same materials if it is not made as one piece with the rest of the collar-shaped anode connection piece 24.

Shown on either side of the grid connection piece 24 and of the cathode connection piece 42 are dielectric separators 43 which are used for electrical insulation and for mechanical retention between the connection pieces and therefore the various electrodes in question.

There is a risk of some of the electrons which pass through the grid 20, around the periphery of the apertured part 23, diverging away from instead of converging on the XX' axis. They will then strike the anode, which reduces the performance of the tube and is undesirable.

Figure 4:
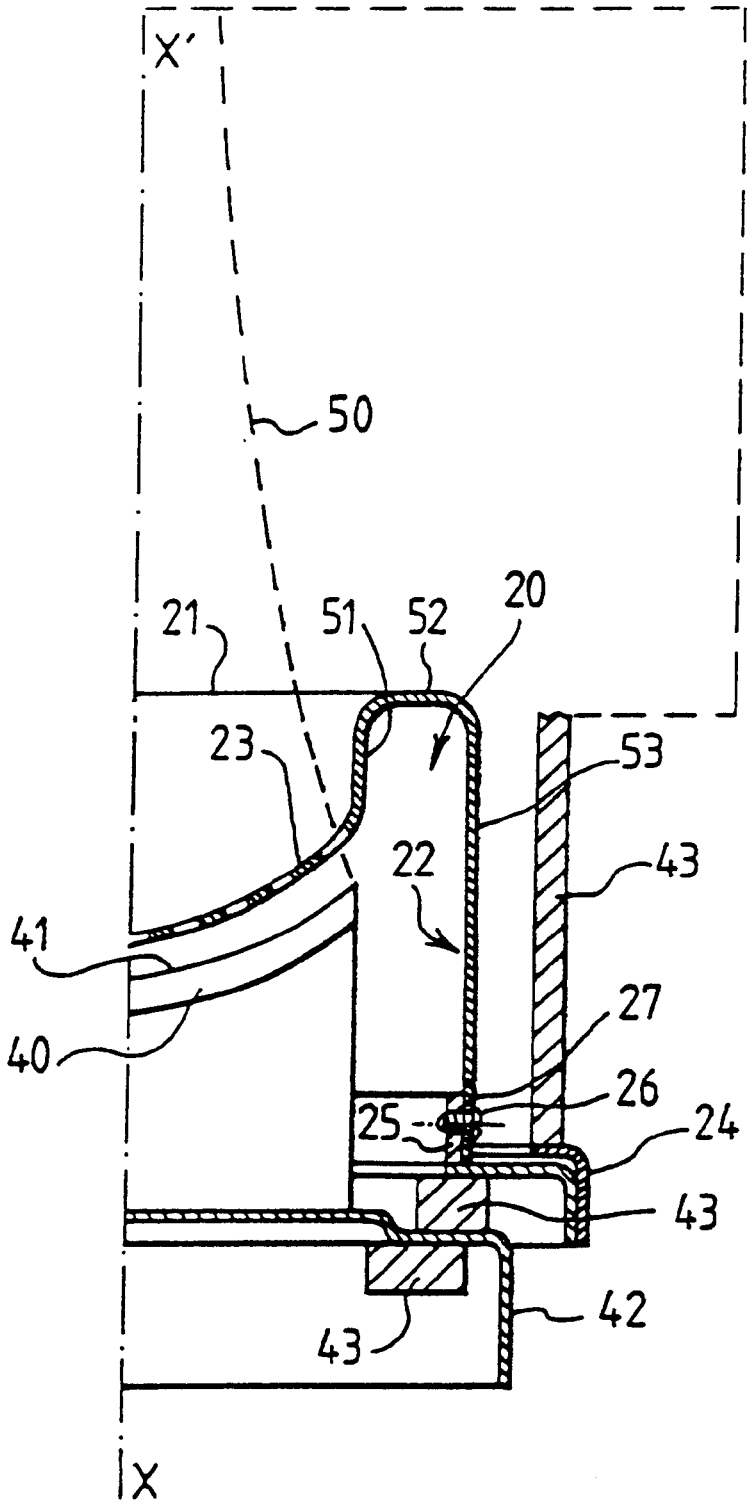
FIG. 4, an axial-beam electron tube according to the invention with a grid whose top has a hollow.

To avoid this drawback and to focus the electrons on the XX' axis better, it is possible to configure the top 21 of the bell 22 in the form of a hollow so that the apertured part 23 lies in the bottom of the hollow. Its periphery is bordered by an approximately cylindrical tubular wall 51 which is fastened to the skirt 53 of the bell 22 by means of an annular part 52. In FIG. 4, which illustrates this alternative form in cross section, the wall of the grid, from the base 27, is a rising wall directed along the XX' axis in the region of the skirt 53, it then returns towards the XX' axis in the region of the annular part 52, it then enters the bell in the region of the tubular wall 51 and terminates in the apertured part 23 which is approximately transverse to the XX' axis. The skirt 53, the annular part 52 and the reentrant tubular wall 51 have approximately the same thickness. The length of the tubular wall 51 is adjusted so as to obtain the focusing action. The tubular wall 51 and the skirt 53 are separated from each other by the annular part 52. The tubular wall 51, which is reentrant with respect to the annular part, is shown approximately vertical. The skirt 53 and the tubular wall 51 are two hollow cylinders mounted approximately coaxially, one in the other, the tubular wall 51 being inside the skirt 53.

This approximately cylindrical tubular wall 51 acts as a wehnelt; it pushes the electrons that have passed through the grid around the periphery of the apertured part back towards the XX' axis—it therefore creates an additional focusing effect. Such a configuration of a pyrolitic graphite grid poses no difficulty in production.

What is claimed is:

1. An electron tube with an axial beam, comprising, in a vacuum envelope, an electron gun for creating and modulating an electron beam directed in a forward direction, said electron gun having a front part and a rear part, said front part comprising an emissive cathode and an apertured portion of a grid, and said rear part comprising a heater for heating the cathode, said rear part being located behind the cathode when looking in said forward direction, said grid being made from a pyrolitic graphite single material and having an axial tubular skirt extending in a rearward direction opposite said forward direction until behind the front part of the electron gun, and said tubular skirt being fixedly mounted on an electrically conductive metallic grid support, said metallic grid support located backwards from said front part when looking in said forward direction.

2. An electron tube according to claim 1, wherein said tube further comprises at least one connection element for an external electrical connection of the grid, said connection element located rearwardly from said front part when looking in said forward directly, and said connection element being in electrical contact with said grid support.

3. An electron tube according to claim 1, wherein said grid has an annular part constituting a most forward portion of said grid, said axial tubular skirt being connected to said apertured portion through said annular part.

4. An electron tube according to claim 3, wherein said grid has an axial tubular portion located between said apertured portion and said annular portion.

5. An electron tube according to claim 4, wherein the tubular skirt, the annular part and the axial tubular portion have approximately a same thickness.

6. An electron tube according to claim 1, wherein said tubular skirt has a tubular rear, end portion and said grid support has a tubular portion, coaxial with said tubular skirt, and wherein said tubular rear portion of the tubular skirt and said tubular portion of the support are tightly plugged into one another.

7. An electron tube according to claim 6, wherein said tubular rear end portion of the tubular skirt is fixed to the support by screws.

8. An electron tube according to claim 6, wherein said tubular rear end portion of the tubular skirt is fixed to the support by solder.

9. An electron tube according to claim 1, wherein said tubular skirt has a series of slots oriented approximately along the axis of said tubular skirt to allow elastic compensation for differences in expansion occurring between the grid and the grid support.

10. An electron tube according to claim 9, wherein a rearward end of the slots stops short of an edge of the tubular skirt so as to define a spacer between the rearward end of the slots and the edge of the tubular skirt.

11. An electron tube according to claim 9, wherein the slots have a front part and a rear part joined together, said front and rear parts having different widths.

12. An electron tube according to claim 9, wherein the slots have a substantially constant width.

* * * * *